US005819673A

United States Patent [19]

Heywood et al.

[11] Patent Number: 5,819,673

[45] Date of Patent: Oct. 13, 1998

[54] SYSTEMS FOR THE TREATMENT OF CHEMICAL WASTES AND METHODS FOR TREATING CHEMICAL WASTES

[75] Inventors: Ann C. Heywood, Danville; Richard J. Martin; John D. Stilger, both of San Jose, all of Calif.; Andrew B. King, Yorkshire, England

[73] Assignee: Thermatrix Inc., San Jose, Calif.

[21] Appl. No.: 729,850

[22] Filed: Oct. 15, 1996

[51] Int. Cl.[6] ..... F23G 7/00

[52] U.S. Cl. ..... 110/346; 110/236; 110/238; 432/179; 431/5

[58] Field of Search ..... 110/236, 237, 110/238, 346; 432/179, 180, 181, 182; 431/5, 7, 170

[56] References Cited

U.S. PATENT DOCUMENTS

| | | | |
|---|---|---|---|
| 4,688,495 | 8/1987 | Galloway | 110/250 |
| 4,823,711 | 4/1989 | Kroneberger et al. | 110/236 |
| 5,165,884 | 11/1992 | Martin et al. | 431/7 |
| 5,320,518 | 6/1994 | Stilger et al. | 431/7 |
| 5,533,890 | 7/1996 | Holst et al. | 431/5 |

OTHER PUBLICATIONS

Alternate Technologies for the Destruction of Chemical Agents and Munitions—National Research Council (1993).

Workshop on Advances in Alternative Demilitarization Technologies, Sep. 25–27, 1995, Hyatt Regency, Reston, Va.

*Primary Examiner*—Henry A. Bennett
*Assistant Examiner*—Pamela A. O'Connor
*Attorney, Agent, or Firm*—Woodcock Washburn Kurtz Mackiewicz & Norris LLP

[57] ABSTRACT

Improved methods for the treatment of liquid chemical compounds and process systems for practicing those methods are provided. The methods are practiced by spraying the liquid chemical compounds into a matrix bed of heat resistant materials at temperatures sufficiently high to oxidize the chemical compounds. The sprayed liquid chemical compound is preferably heated to its gaseous state prior to contacting the matrix bed. Processing steps for removing coke deposits in the matrix bed are also provided. The methods are particularly advantageous for the destruction of chemical agents and munitions.

22 Claims, 3 Drawing Sheets

SYSTEMS FOR THE TREATMENT OF CHEMICAL WASTES AND METHODS FOR TREATING CHEMICAL WASTES

FIELD OF THE INVENTION

The present inventions relate to systems and methods for the treatment of chemical wastes. More specifically, the present inventions relate to improved techniques for treating liquid chemical wastes, and particularly chemical agents used in chemical warfare munitions, and systems to destroy those materials in a safe and efficient manner.

BACKGROUND OF THE INVENTION

In various industrial settings there exists chemical compounds that must be destroyed in some fashion. In some cases, these chemical compounds are liquids. For instance, various governments throughout the world are custodians of stockpiles of chemical agents used in chemical warfare munitions. These agents include nerve, mustard, blister gases, etc. There is currently a movement to destroy these chemical agents in a safe and efficient manner. Problems arise due to the highly toxic nature of these compounds and the need for very thorough destruction efficiencies.

Various modes of destruction for these chemical agents have been studied for their utility. Examples of suggested destruction systems include incineration; reaction with alkali chemicals (neutralization); low-temperature, liquid phase processing;

biological processing; wet air oxidation; supercritical water oxidation; high-temperature low-pressure pyrolysis techniques; etc. as discussed in "Alternative Technologies for the Destruction of Chemical Agents and Munitiions," National Research Council (1993). However, each of these systems typically has either technical or efficiency concerns.

Flameless oxidation systems are known for use in the destruction of gaseous volatile organic compounds (VOCs). Such systems are currently available from Thermatrix, Inc. (San Jose, Calif.). These systems are well known for their high destruction efficiencies that are typically well above 99%. Examples of these systems are set forth in U.S. Pat. Nos. 4,688,495, 5,165,884, and 5,320,518. However, this technology and its uses have been applied to gaseous feed material streams. Application to liquid organic feed streams would result in the formation of coke deposits immediately upon introduction of the liquid feed into the matrix bed of heat resistant materials contained within the thermal oxidizer. This could eventually result in an unacceptable pressure differential in the oxidizer and result in failure of the unit to function properly.

Thus, there exists a need to efficiently and safely dispose of certain liquid chemical compounds and agents. Modifications to existing technology may provide the answers to the creation of a system to handle such waste streams.

SUMMARY OF THE INVENTION

The present invention provides methods for the treatment and destruction of liquid, organic chemical compounds, and systems to practice those methods. The present invention is particularly well-suited for handling the destruction of chemical agents used in warfare munitions. The liquid chemical compounds are destroyed within a thermal oxidizer that contains a matrix bed of heat resistant material that is maintained at temperatures above about 1400° F.

In one embodiment of the methods of the present invention there is provided a thermal oxidizer that contains a matrix bed of heat resistant material. The liquid, organic chemical compounds are fed into a spray nozzle to form spray droplets of the chemical compound. The spray droplets are heated to their gaseous state and are oxidized within a portion of the matrix bed that is maintained at a temperature above 1400° F. It is preferred that the thermal oxidizer has a specially designed inlet chamber that is a substantially hollow chamber extending into the matrix bed for a fixed distance. The spray droplets are directed into the inlet chamber within which the spray is vaporized to a substantial extent prior to contacting the matrix bed. The inlet chamber is heated by the matrix bed, which preferably, at least partially, surrounds the inlet chamber.

The use of liquid chemical compounds may result in the generation of coke within the matrix bed and/or the inlet chamber. To remove the coke deposits, the feed of the chemical compound is suspended to the spray nozzle, and the inlet chamber and/or matrix bed is heated to remove the coke deposits. In dealing with chemical agents, there may be formed phosphorus oxide compounds within the matrix bed, and these can also be removed by heating those portions of the matrix bed.

In one embodiment of the present invention there is provided a thermal oxidizer for treating and destroying liquid chemical compounds. The oxidizer has an inlet chamber for receiving a spray of a liquid chemical compound and for vaporizing the liquid chemical compound. The thermal oxidizer has an outlet for removing reaction gaseous products from the thermal oxidizer. Within the oxidizer there is a gaseous oxidation section located between the inlet and the outlet that contains a matrix bed of heat resistant material. The inlet chamber is substantially hollow and extends into the matrix bed of heat resistant material. The thermal oxidizer system also contains a spray nozzle having an inlet to receive the liquid chemical compound and an outlet extending into the inlet chamber.

DETAILED DESCRIPTION OF THE INVENTION

The present invention provides systems for the improved treatment of liquid chemical compounds, and in particular those chemical compounds that are referred to as chemical agents, which constitute chemical warfare munitions that are currently stockpiled by various governments for military use.

The chemical agents that are to be treated in accordance with the present invention are generally defined as those chemical compounds used in chemical agent weapons and munitions. These materials include, but are not limited to, such agents as nerve agents or gas, blister agents, mustard agents, etc. These materials typically, but not in all cases, can contain such compounds as persistent VX (O-ethyl-S-[2-diisopropyl aminoethyl]methylphosphonothiolate), non-persistent Sarin (GB)(isopropyl methyl phosphonofluoridate), and Tabun (GA)(ethyl-N,N-dimethyl phosphoramidocyanidate). The nerve agents are typically organophosphate compounds, which contain phosphorus double-bonded to an oxygen atom and single-bonded to a carbon atom. These materials are typically liquids at normal conditions of temperature and pressure.

These chemical warfare agents are stored in two general forms: (1) bulk liquid form in steel ton containers, and (2) in munition format as in the form of a bomb or projectile with an associated propellant. The form in which the chemical agent is presented is not a part of this invention and the ton container will be used throughout this description of the invention for illustrative purposes.

The present systems described herein are specifically suited for use in the destruction of the chemical agents described above. However, these systems can similarly be used to destroy any organic, liquid chemical compounds that can be oxidized by exposure to high temperatures in oxidating conditions. These liquid chemical compounds preferably can be sprayed to form a mist such as by spray atomization or preferably can be volatilized to form a gas or other air-mobile fluid. These liquid chemical compounds can also be blended with a solvent to improve their flow characteristics if necessary to make the liquid chemical compounds easier to pump and to form a spray or mist.

Figure 1:
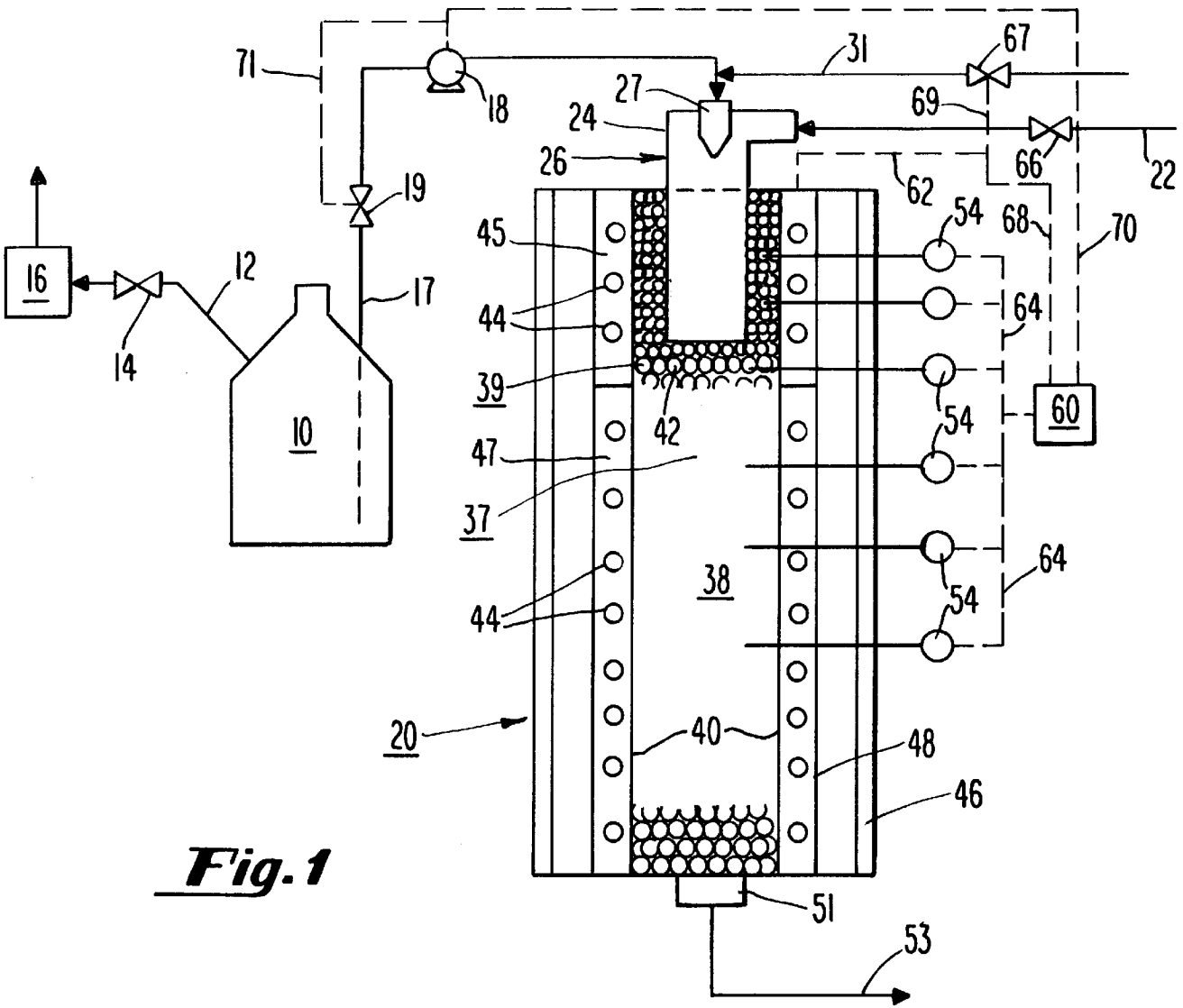
FIG. 1 is a schematic representation of the processing system of the present invention along with a cross-sectional view of an embodiment of the thermal oxidizer of the present invention.

One embodiment of a system of the present invention is shown in FIG. 1. In this embodiment a ton container (10) contains a liquid chemical compound, in this case for illustrative purposes it is a chemical agent, to be treated in a thermal oxidizer (20). The invention will herein be described with respect to chemical agents as being representative of all liquid chemical compounds. The ton container (10) is outfitted with a vent system to capture fumes that may accidently leave the container (10) and to permit air to enter as the liquid is evacuated. The vent system comprises a line (12) that leads to a valve (14) and through a filter (16), such as a carbon filter. The filtered gases are then vented to the atmosphere. The thermal oxidizer (20) is used to destroy the chemical agent stored within the ton container (10).

The technology relating to the use of thermal oxidizers has been significantly advanced in the recent years. Significant research into the phenomena of oxidation within porous inert media (PIM) has been undertaken. Because PIM oxidation can occur outside the normal premixed fuel/air flammability limits, the technology can be called "flameless." In this regard U.S. Pat. Nos. 4,688,495 (Galloway) and 4,823,711 (Kroneberger et al.) disclose early work on matrix oxidation technology. In addition, U.S. Pat. Nos. 5,165,884 (Martin et al.), 5,320,518 (Stilger et al.), and 5,533,890 (Holst et al.) discuss in significant detail the technology involved in the designing of a thermal oxidizer (20). The issued Martin et al, Stilger et al., Holst et al., Galloway, and Kroneberger et al. patents are hereby incorporated in their entireties by reference.

In the embodiment of the present invention shown in FIG. 1, the liquid chemical agent is removed from the ton container (10). The removal of the chemical agent can be accomplished by various means, such as by a pump 18 or by the negative pressure induced by an atomization spray nozzle (to be discussed later). The chemical agent is transported from the ton container (10) via line (17) and through an optional control valve (19). The chemical agent is then introduced into the thermal oxidizer (20).

Typically, the thermal oxidizer (20) will consist of a high-alloy matrix bed containment shell (40) that is filled with a quantity of heat resistant material (42) so as to create a matrix bed (38). The containment shell (40) will preferably be of sufficient mechanical strength to prevent rupture even in the event of a detonation generating significant pressures. Heating elements (44), which are preferably electric, surround this inner containment shell (40) in the first portion of the thermal oxidizer and are capable of providing the system with preheating and proper temperature maintenance during operation.

The entire thermal oxidation assembly will be mounted in an outer containment shell (46), preferably made of carbon steel. This outer containment shell (46) is preferably lined with high temperature insulation (48) in the entirety of the region of the matrix bed containment shell (40).

Upon entering the thermal oxidizer (20), the liquid stream, which is preferably transformed into a spray or mist, will be heated to vaporize the spray droplets from the heat from the matrix bed (38), thus resulting in the formation of a gaseous state chemical agent. The temperature of the matrix bed (38) will vary along the flowpath of the chemical agent as that material traverses through the oxidizer (20). The temperature of the matrix bed 38 will generally be as low as about 200° F.–800° F. at the entrance of the oxidizer (20) and will increase to the area of the matrix bed (38) within which the oxidation occurs, where the matrix bed (38) temperature is generally at least 1400° F., typically at least 1600° F., and preferably at least 1800° F. The now gaseous stream of the chemical agent is then maintained at the oxidation temperature for a sufficient residence time to ensure substantially complete destruction of the chemical agent and for the substantially complete conversion of these agents to such compounds as $CO_2$, $H_2O$, HCl, HF, $P_2O_5$, $SO_2$, etc. The result of this heating of the chemical agent is the creation of a flameless oxidation wave within the matrix bed (38) whereby the chemical agent is ignited and oxidized. The oxidation wave is observed as a steep increase in bed temperature from the temperature of the incoming chemical agent on the inlet side of the wave to approximately the adiabatic combustion temperature of the mixture on the outlet side of the wave. This rapid change takes place over a distance of usually several inches in a typical oxidizer (20), with the actual distance being dependent upon feed concentrations, feed rates, gas velocity distribution, bed material, and bed physical properties, type of specific feed materials, etc. Heat losses in the direction of flow also will have an effect on the length of the oxidation wave. The temperature of the oxidation is dependent upon feed concentrations, feed rates, gas velocity distribution, bed physical properties, type of specific feed materials, heat losses, heat input from the heaters, etc.

The destruction efficiency of the thermal oxidizer is at least about 99.9%, preferably at least 99.99%, more preferably at least 99.999%, and even more preferably at least 99.9999%, by weight. That is, at least that percent by weight of all organic compounds entering the thermal oxidizer are destroyed, or oxidized, within the oxidizer. The space velocity of the gases in the heated reaction zone will typically be in the range of 1800 $hr^{-1}$ to 7200 $hr^{-1}$.

Upon start up of the oxidizer (20) as depicted in FIG. 1, the heating elements (44), which are preferably electrical heaters, are activated to raise the temperature within the matrix bed (38) up to operating temperature. This is accomplished by flowing air, via line (22) through the oxidizer inlet (24) and through the oxidizer (20).

The heating elements (44) thereby raise the temperature within the matrix bed to the preferred operating temperature. The heating elements (44) preferably extend through the entire length of the oxidizer (20) as shown in FIG. 1. The full extension of the heating elements (44) allows for the operation of the oxidizer (20) in a mode that the matrix bed (38) temperature can be maintained above a minimum temperature, say about 1000° F., to reduce the possibility of forming precipitated solid phosphorus oxides onto the matrix materials (42). In preferred operations, the matrix bed (38) is temperature profiled such that the bed temperature proximate to the oxidizer inlet (24) is below the temperature required to oxidize the chemical agents such that the chemical agents do not oxidize until they enter into a predetermined reaction wave zone, which is preferably maintained proximate to the end (28) of the injection inlet system (26).

Once the matrix bed temperature profile has been established, the flow of the chemical agent into the oxidizer (20) can be initiated, for example, by activation of valve (19) and pump (18). The chemical agent is thereby transferred from the container (10) to the oxidizer inlet (24). The chemical agent will then be heated due to the elevated temperatures maintained within the oxidizer (20) resulting in a change of state from a liquid to a gas. The gaseous chemical agent will contact the matrix bed (38) resulting in destruction of the chemical agent to less harmful products of the oxidation reaction. The oxidation products will exit the oxidizer (20) though the outlet (51) via line (53).

The treatment of liquid materials, such as the chemical agents described herein, may pose problems with the operation of the oxidizer (20). The heating of the chemical agents from their normal liquid state to a gaseous state may result in the formation of significant amounts of carbon residue or coke if the compounds are heated too slowly. Also, if the matrix bed (38) temperature is too low, the presence of organo-phosphorus compounds in the chemical agents may lead to the deposition of solid phosphorus oxides within the matrix bed (38).

As shown in the preferred embodiment set forth in FIG. 1, the oxidizer (20) is configured with a specialized injection system (26), which includes a spray atomization nozzle (27) that is contained within an inlet chamber (29) that extends into the matrix bed (38) in the direction of the flow of the reactants through the oxidizer (20), which is the preferred design, although the inlet chamber (29) can be configured to enter into the matrix bed (38) at various angles to the direction of flow of the reactants through the oxidizer (20). The liquid chemical agent is transported through line (17) into the nozzle (27) wherein it is atomized into a spray that is forced into the inlet chamber (29). It is preferred that the chemical agent be admixed with spray or atomization air supplied through line (31) to create the spray of the chemical agent, although atomization air is not required for practicing the present invention. The inlet chamber (29) can be constructed of chamber walls (30) that are constructed with similar materials as the walls (40). The spray, preferably atomization, of the liquid chemical agent allows for that agent material to more readily accept heat and to convert it rapidly to a gaseous material for oxidation within the matrix bed (38). The result will be that there will not be a formation of a significant coke layer at the inlet of the oxidizer (20), which would be the case if the liquid feed were merely introduced into the oxidizer (20) without any pre-treatment or if the liquid chemical or agent were vaporized directly.

The inlet chamber (29) is preferably constructed such that it extends into the first portion (39) of the matrix bed (38). In such a way, the spray from the nozzle (27) travels a distance through the oxidizer (20) within the inlet chamber (29) without contacting the matrix bed (38). Thus, the spray will be heated, and preferably a significant portion will be heated to its gaseous state, within the inlet chamber (29), prior to contacting the matrix bed (38), although the heat from the matrix bed (38) is utilized to vaporize the spray droplets of the chemical agent. The inlet chamber (29) is preferably constructed such that it does not contain any significant amount of matrix material and can thus be termed substantially hollow. These design features should greatly reduce the formation of coke in the matrix bed (38), although it is anticipated that coke may be formed on the walls (30) of the inlet chamber (29) and in the portion of the matrix bed (38) that is adjacent to the outlet of the inlet chamber (29). The distance to which the bottom (28) of the inlet chamber (29) extends into the matrix bed (38) can depend on various factors, however it is preferred that it extend at least 10%, preferably at least 15%, and more preferably at least 20%, of the distance of the length of the entire matrix bed (38). The bottom (28) can be constructed of a grate or mesh screen to prevent the matrix bed materials from entering the inlet chamber (29) or the bottom (28) can just be an opening defined by the walls (30), with care taken during the set up of the matrix bed to ensure that the matrix materials (42) do not extend significantly into the inlet chamber (29) area.

The oxidizer (20) shown in FIG. 1 is also configured with two sets of heating elements (44) that preferably surround the matrix bed (38). The first group (45) of heating elements (44) is located at the inlet end of the oxidizer (20). The second group (47) of heating elements (44) is located downstream of the first group (45). The provision of two separate groups (45), (47) of heating elements (44) allows for the controlled heating of the first portion (39) of matrix bed (38) at selected time intervals to remove any coke or phosphorus oxide solids that may be present in the system due to the operation of the unit with the chemical agents.

For example, in a typical operation, the first set (45) of heating elements (44) may extend about one-third of the length of the matrix bed (38), thus defining the first portion (39) of the matrix bed (38). This portion of the matrix bed (38) may be maintained at temperatures between about 100° F. and 800° F. The second portion (37) of the matrix bed (38) that is adjacent to and immediately downstream from the first portion (39) is where the reaction or oxidation wave is preferably located, and thus the temperature range is between about 1600° F. and about 2000° F. Thus, for example, after a period of time of destroying the chemical agents within the oxidizer (20), the flow of the chemical agents to the oxidizer (20) is suspended while air flow, either via line (31) or (22), is maintained. At the same time, the first set (45) of heating elements (44) are activated to an extent to raise the first portion (39) of the matrix bed (38) to temperatures high enough to burn off the coke deposits and to vaporize or sublime any phosphorus oxide compounds, preferably at least about 1000° F., more preferably at least about 1250° F., and even more preferably at least about 1500° F.

Typical materials used to construct the matrix bed (38) are made of ceramic materials, which may be randomly packed or structurally packed. Preferred random packing comprises ceramic balls that may be layered. Generally, for oxidation of hydrocarbon gases, the ceramic balls are useful if they have a diameter from about 0.06(25) to 3 inches (0.159–7.62 cm), preferably about ¾ inch (1.9 cm). Another useful configuration is the use of random ceramic saddles typically from 0.06(25) to 3 inch (0.159–7.62 cm) nominal size, preferably about ½ to 1.5 inches (1.(27)–3.81 cm) nominal size. Other useful packing materials are pall rings and raschig rings with diameters from about 0.06(25) to 3 inches (0.159–7.62 cm), and preferably from about ½ to 1.5 inches (1.(27)–3.81 cm). Other shapes of ceramic material may be utilized such as honeycomb shape ceramic.

A ceramic foam material may also be utilized to construct the matrix bed (38). Typical foam material that can be utilized has a void fraction of 10 to 99%, preferably 75 to 95%, and most preferably about 90%. The pore sizes in any preferred ceramic foam material will be about 0.1 to 1,000 pores per inch (0.04 to 400 pores per cm), preferably about 1 to 100 pores per inch (0.4 to 40 pores per cm), and most preferably about 10 to 30 pores per inch (4 to 12 pores per cm).

Instead of a ceramic, the heat-resistant material used to form the matrix bed (38) may also be a metal, which may be randomly packed or may have a structured packing. A pre-designed, single piece metal structure can also be used to constitute the matrix bed (38), which structure can be secured to the containment shell (40) and thereby easily removed for maintenance purposes. It is preferred that the materials that constitute the matrix bed (38) are non-catalytic. By non-catalytic, it is meant that the material that constitutes the matrix bed (38) does not significantly lower the temperature at which the chemical agents are oxidized. That is, the mode of oxidation in the thermal oxidizer (20) is primarily due to the elevated temperatures within the matrix bed (38) and not due to the surface chemistry of the matrix bed material (42).

Generally, the void fraction of the matrix bed will be between 0.3 and 0.9. In addition, the material in the matrix bed will typically have a specific surface area ranging from 40 $m^2/m^3$ to 1040 $m^2/m^3$.

Thus, the basics of the preferred embodiments of the thermal oxidizer of the present invention have been disclosed. Many variations on, and additions to, these basic embodiments are also possible.

Typically, the thermal oxidizer (20) will contain various temperature sensors (54), as shown in FIG. 1, to detect unacceptably high or low temperatures within the matrix bed (38) and thereby control the heating elements (44). Preferably, if excessively high temperatures are detected at the exit (51) of the thermal oxidizer (20), then a thermal safety valve will fail and close to shut off all flow.

Also typically, the entire system will be sequenced and operated by a locally mounted process controller (60), which will provide sequencing, control, and safety monitoring. The process controller (60) will receive analog and digital inputs from several instruments mounted in the system, including thermocouples and level switches. In one preferred embodiment of the present invention, the temperature sensors (54), which sense the temperature at various positions within the matrix bed (38) along the gas flowpath, are electronically connected to the process controller (60) via lines (64). The controller (60) can thereby control the oxidizer temperatures during the preheat and operation steps by modulating current to the electric heating elements (44) via line (62) to provide for a controlled system heat-up and for maintenance of oxidation temperature at destruction set points. It will also continuously monitor all system safety interlocks and will shut the system down in a safe manner upon detection of a tripped interlock.

The controller (60) can also be used to regulate the air flow to be admixed with the chemical agents or sent to the unit either with or without the concomitant addition of the chemical agent. As shown in FIG. 1, the controller (60) is electrically wired to air control valve (66) on line (22) and air control valve (67) on line (31) via lines (68) and (69), respectively. The controller (60) can also be used to regulate the pump (18) via line (70) and also to regulate valve (19) via line (71).

Figure 2:
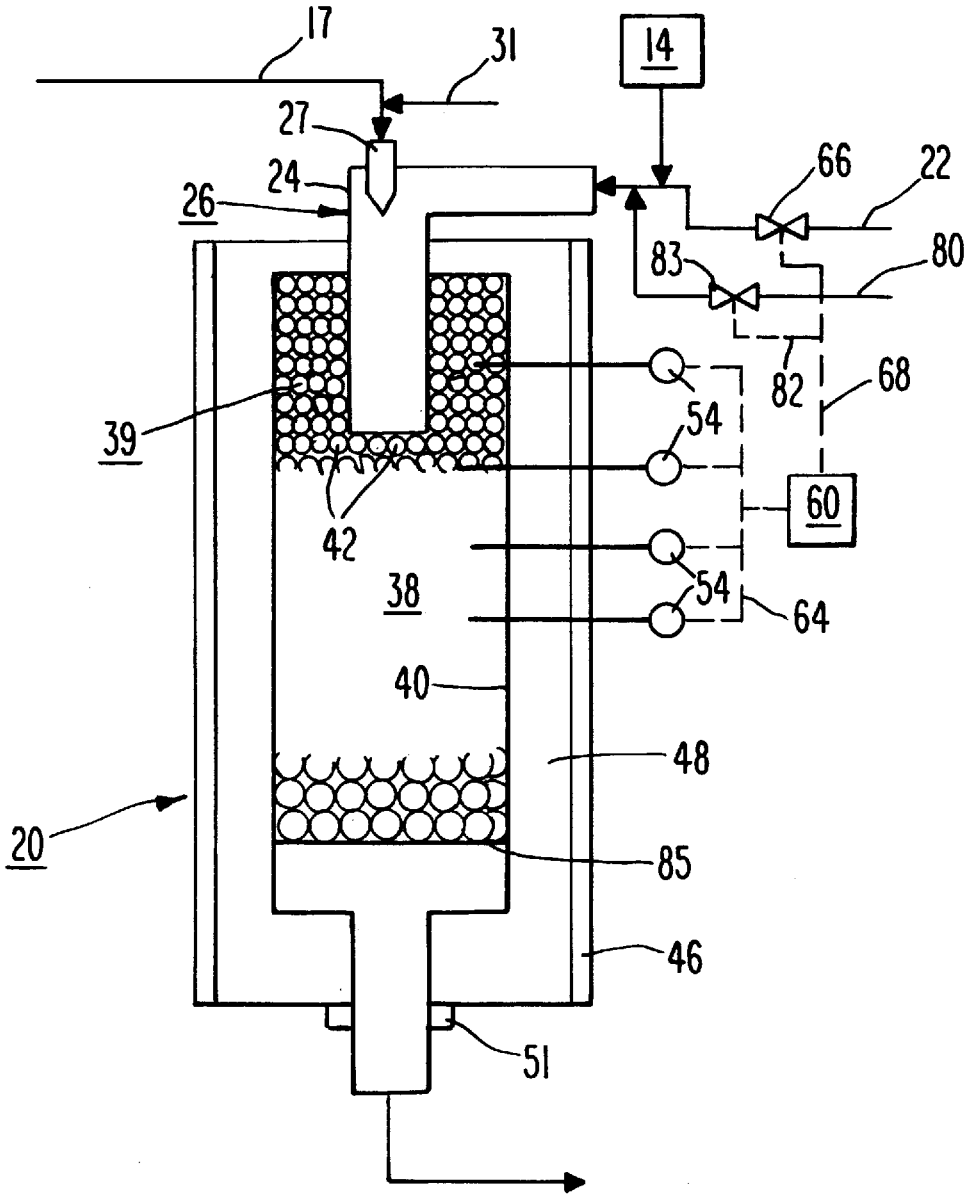
FIG. 2 is a cross-sectional schematic of an embodiment of the thermal oxidizer of the present invention.

The present invention has been shown with the use of an electrically heated oxidizer (20) in FIG. 1. Other oxidizer configurations can also be used such as the one shown in FIG. 2. In this embodiment, the oxidizer (20) is preheated by the use of a preheater (14), fired for example with natural gas, to heat the matrix bed (38) prior to introduction of the chemical agents. Such preheaters (14) include gas burners, electric burners, inductive heaters, radiant tube heaters, etc. The oxidizer (20) as shown in FIG. 2 can also be heated by means of supplemental fuel, such as natural gas, fed via line (80).

The matrix bed (38) temperature can be raised or lowered by the addition rate of supplemental fuel through line (80). This addition of supplemental fuel can be regulated by valve (83) and controlled by controller (60) via line (82). In start up of the system shown in FIG. 2, the preheater (14) can be used in conjunction with the supplemental fuel via line (80) and air via line (22). When the appropriate matrix bed (38) temperatures have been established, the chemical agent flow is initiated via line (17) through the nozzle (27) as described with the system shown in FIG. 1, and the amount of supplemental fuel added is reduced to a point required to maintain appropriate bed temperatures. The system is operated until such time that the build up of coke and/or phosphorus oxide compounds is to a point where remediation is appropriate, at which time the chemical agent flow is suspended and the supplemental fuel is increased along with a decrease in air flow from lines (31) and (22). In such a way, the bed temperature in the first portion (39) of the matrix bed (38) is raised to a temperature to remove a significant portion, and preferably almost all, of the coke and deposited phosphorus oxide compounds. The matrix materials (42) are shown in this embodiment being supported by a plate (85).

Figure 3:
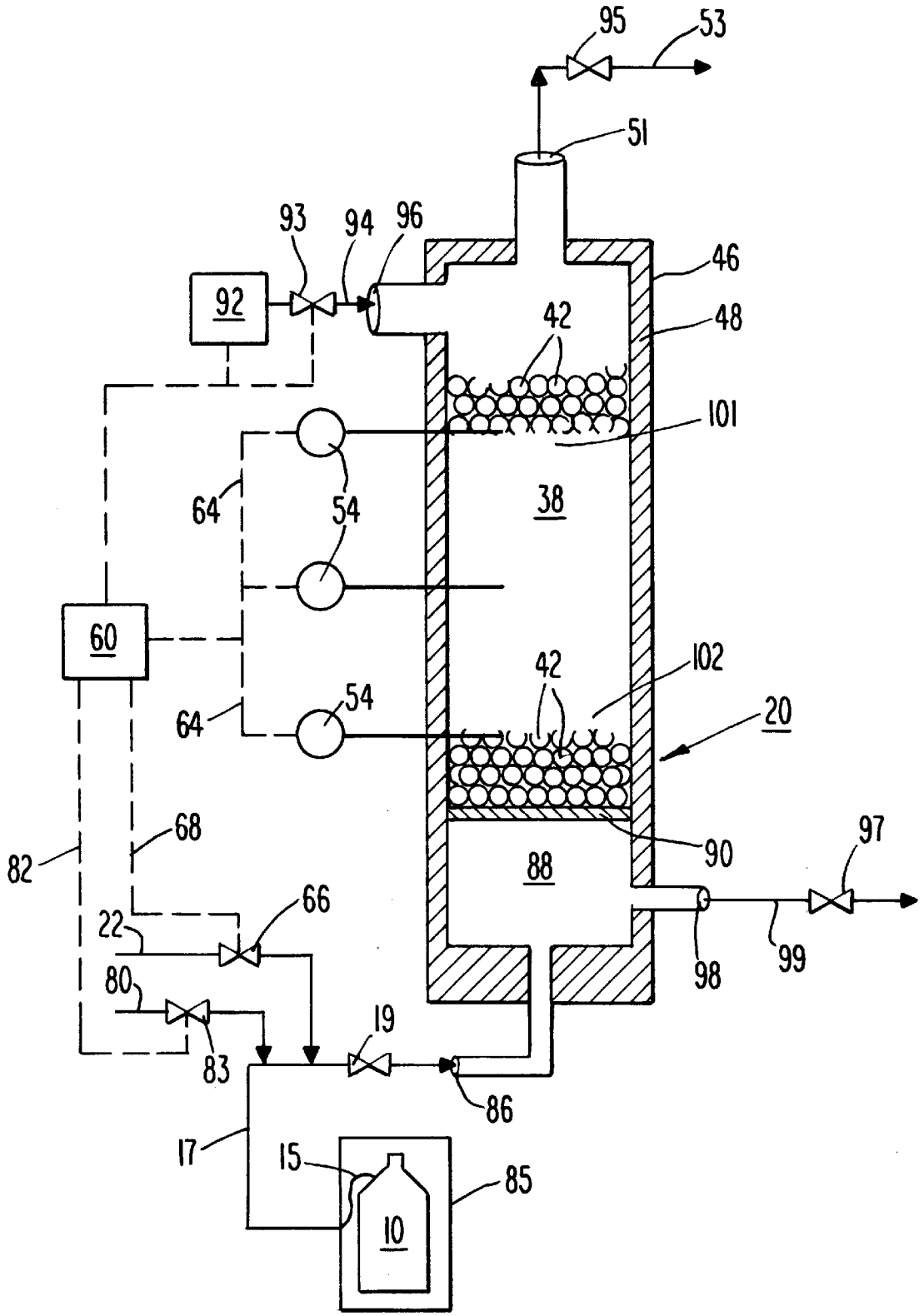
FIG. 3 is a cross-sectional schematic of an embodiment of the system of the present invention.

The destruction of liquid chemical compounds, such as chemical agents, can also be accomplished by first vaporizing or fluidizing the liquid chemical compounds prior to their introduction into the thermal oxidizer. One embodiment of this design is shown in FIG. 3. This design shows that the container (10) having the liquid chemical compounds within it is first placed in a vaporization chamber (85). The vaporization chamber (85) is any device that can be used to heat the contents of the container (10) by such means as radiant heat, microwave heat, etc. The container (10) is connected to line (17), which leads to the inlet (86) of the oxidizer (20), by line (15). Valve (19) controls the flow of the gaseous or fluidized chemical compounds.

The vaporization chamber (85), for use with chemical agents, can incorporate a $UF_6$ vaporization system. In such a process, the container (10) is connected to a feed tube, such as line (15), and electrical heat is applied to the container (10) within the vaporization chamber (85). The container (10) is heated to a temperature above the atmospheric boiling point of the chemical compound, typically above about 600° F., and the chemical compound is transferred via line (17) to the inlet (86) of the oxidizer (20). The vaporized chemical compound can be admixed with warm air, preferably at temperatures of at least about 250° F., more preferably at least about 300° F., from line (22), prior to entering the oxidizer (20). When the container is substantially emptied of the chemical compound, the temperature in the chamber (85) can be raised to about 1000° F. for at least about 15 minutes to completely remove the chemical compound residue from the container (10).

The vaporized chemical compound, optionally admixed with air via line (22), can also be admixed with supplemental fuel, such as natural gas or propane, via line (80), prior to introduction to the oxidizer (20). This gaseous mixture can enter into a plenum (88) that acts to evenly distribute the gases entering the oxidizer (20) and further mix these gases prior to entering the matrix bed (38). It is believed that this helps to achieve a relatively flat cross-sectional profile of the oxidation wave perpendicular to the direction of the flow of the gases through the matrix bed (38). In some instances the plenum (88) may be desirable to achieve the flatness of the cross-section of the wave, depending on the configuration of the matrix bed (38). As shown in FIG. 3, the plenum (88) is separated from the matrix bed (38) by the plenum plate (90), which is gas permeable.

The plenum (88) is shown in FIG. 3 as being a void space. However, the plenum (88) can also be filled with matrix material (42) as described in U.S. Ser. No. 08/347,870, which is hereby incorporated in its entirety by reference. For instance, the plenum (88) can contain a different type of matrix material (42) (e.g., ceramic balls) than that used in the matrix bed (38) (e.g., ceramic saddles). In such a construction, the plenum (88) would typically have an interstitial volume in the range of about 40% and the matrix bed (38) would have an interstitial volume in the range of about 70%.

The position and stability of the oxidation wave within the thermal oxidizer (20) can be controlled by means of the process controller (60). Prior to entering the thermal oxidizer (20), supplemental air, carried via line (22), can be injected into the process gases carried along line (17), or supplemental fuel, such as natural gas or propane, can be injected into the process gases via line (80). The rates of addition of the supplemental air and/or fuel can be regulated through use of a process controller (60) that is electronically wired to a control valve (66) on the air line (22) and to a control valve (83) on the fuel line (80), via lines (68) and (82), respectively. The supplemental fuel and/or air are used to maintain an oxidation wave within the thermal oxidizer (20).

The process controller 60 can also control the flow rate of the process gases via valve (19), which can be electronically wired (not shown) to the controller (60). The process controller (60) is also preferably used to monitor the temperature within a plurality of locations within the matrix bed (38). As shown in FIG. 3, the thermocouples (54) are situated to monitor the temperature within the matrix bed (38) and their output is electronically relayed to the process controller (60) via lines (64). In such a way, the temperatures within the matrix bed (38) can be utilized to control the flow of the supplemental air (22) and/or fuel (80) and the process gases through line (17).

The thermal oxidizer (20) has an outer containment shell (46) that is preferably made of carbon steel. This outer containment shell (46) is preferably lined with high temperature insulation (48).

After thorough destruction of the chemical compounds within the thermal oxidizer (20), the resulting gaseous products will exit the oxidizer (20) through the process fluid outlet (51) via line (53).

The thermal oxidizer (20) functions to destroy the chemical compounds or agents by raising those materials to a temperature at which they readily oxidize within the matrix bed (38) of matrix materials (42). As such, prior to the introduction of the chemical compounds into the thermal oxidizer (20), a portion of the matrix bed (38) is preferably raised to a temperature above the auto-ignition point of the incoming process fluid. The design as shown in FIG. 3 incorporates a novel preheating procedure as set forth in U.S. Ser. No. 08/659,579 filed on Jun. 6, 1996, which is hereby incorporated by reference in its entirety. The preheating procedures can be more fully understood by reference to FIG. 3 which illustrates a thermal oxidizer designed for a "bottom-up" process fluid flow path. The matrix bed (38) within the thermal oxidizer (20) can be preheated by directing a preheating fluid from the preheater (92) through line (94) and through a preheater inlet (96), which is located vertically above the matrix bed in this embodiment. The preheating fluid thus enters the thermal oxidizer (20), is directed downward through the matrix bed (38), and exits through the preheater fluid outlet (98) within line (99).

The preheater (94) can be any device that will create a heated fluid that can be used to raise the temperature of the matrix bed (38). Typically, the preheater (94) will be a gas burner, fired by natural gas, which can typically produce a preheating gas having a temperature above 1400° F., and more commonly between about 1600° F. and 2200° F.

The preheating step can be accomplished, as shown in FIG. 3, by initially closing valve (19) on the inlet line for the process fluid stream and closing valve (95) on the outlet line (53) for the gases exiting the thermal oxidizer, so that the preheating fluid flows through the matrix bed (38). Valve (93) on the preheating fluid inlet line (94) and valve (97) on the preheating fluid exit line (99) will be opened during the preheating step. The preheating will continue for a period of time sufficient to preheat a portion of the matrix bed (38) such that upon introduction of the process fluid into the bed the VOCs within those gases will be oxidized. Thus, the entirety of the matrix bed (38) does not have to be, and is preferably not, preheated to the temperature at which oxidation of the chemical compounds will take place. In preferred embodiments, the matrix bed will be preheated such that the portion of the matrix bed (38) that is opposite, or distant, from the point of the introduction of the process fluids will be at a temperature above the oxidation temperature of the chemical compounds, while the portion of the matrix bed (38) that is proximate to the point of the introduction of the process fluids will be at a temperature below that oxidation temperature.

The difference in temperature between the upper portion (101) and the lower portion (102) of the matrix bed (38) (see FIG. 3) after the preheating step has been conducted is primarily due to the convective heat absorption characteristics of the matrix materials (42). These materials readily absorb the heat from the heating fluid and thus the matrix bed (38) is heated in an advancing wave fashion rather than as a collective mass of material.

The preheating sequence can be controlled by the process controller (60). The thermocouples (54) can be used to monitor the temperature profile of the matrix bed (38). When the upper portion (101) of the matrix bed (38) reaches a sufficiently high temperature, the controller (60) can be used to shut off the preheater (94).

The thermal oxidizer (20) is switched from preheat mode to operation mode by closing valves (93) and (97), and opening valves (19) and (95). The process fluid can then be introduced into the oxidizer (20). These steps can all be regulated by the controller (60).

The gases exiting the thermal oxidizer (20) in all embodiments of the present invention can be treated prior to release to the atmosphere using conventional technology.

Although the present invention has been described above with respect to particular preferred embodiments, it will be apparent to those skilled in the art that numerous modifications and variations can be made to those designs. The descriptions provided are for illustrative purposes and are not intended to limit the invention.

What is claimed is:

1. A method for the destruction of organic, liquid chemical compounds, comprising the steps of:

(a) providing a thermal oxidizer containing a matrix bed of heat resistant material;

(b) feeding a liquid, organic chemical compound into a spray nozzle to form spray droplets of the chemical compound;

(c) heating the spray droplets of the chemical compound to their gaseous state; and (d) oxidizing the chemical compound within a portion of the matrix bed maintained at a temperature of at least 1400° F.

2. The method of claim 1 further comprising feeding air into the spray nozzle.

3. The method of claim 1 wherein said thermal oxidizer comprises a substantially hollow inlet chamber that extends into the matrix bed in the direction of the flow of the chemical agent and further comprising directing the spray droplets from the spray nozzle into the inlet chamber.

4. The method of claim 3 wherein the heating of the spray droplets of the chemical compound to their gaseous state occurs within the inlet chamber.

5. The method of claim 1 further comprising:

(i) forming coke within said matrix bed from the chemical compound;

(ii) suspending the feeding of the chemical compound to the spray nozzle;

(iii) heating the portion of the matrix bed containing the coke deposits to a temperature of at least about 1000° F. to remove at least a portion of the coke deposits.

6. The method of claim 1 wherein said chemical compound comprises a chemical agent.

7. The method of claim 6 further comprising:

(i) forming phosphorus oxide compounds within said matrix bed from the chemical agent;

(ii) suspending the feeding of the chemical agent to the spray nozzle;

(iii) heating the portion of the matrix bed containing the phosphorus oxide compounds to a temperature of at least about 1000° F. to remove at least a portion of the phosphorus oxide compounds.

8. The method of claim 6 wherein said chemical agent comprises nerve agents or blister agents.

9. A method for the destruction of liquid chemical compounds, comprising the steps of:

(a) vaporizing a liquid chemical compound to form a gas or fluid state comprising the chemical compound;

(b) flowing the vaporized liquid chemical compound into a thermal oxidizer comprising a matrix bed of heat resistant material; and (c) oxidizing the vaporized liquid chemical compound within the matrix bed at a temperature of at least about 1400° F. to destroy the chemical compound.

10. The method of claim 9 wherein the chemical compound comprises a chemical agent.

11. The method of claim 10 wherein the chemical compound comprises a chemical agent.

12. The method of claim 10 further comprising:

(i) forming phosphorus oxide compounds within said matrix bed from the chemical agent;

(ii) suspending the feeding of the chemical agent to the spray nozzle;

(iii) heating the portion of the matrix bed containing the phosphorus oxide compounds to a temperature of at least about 1000° F. to remove at least a portion of the phosphorus oxide compounds.

13. The method of claim 9 further comprising:

(i) forming coke within said matrix bed from the chemical compound;

(ii) suspending the feeding of the chemical compound to the spray nozzle;

(iii) heating the portion of the matrix bed containing the coke deposits to a temperature of at least about 1000° F. to remove at least a portion of the coke deposits.

14. The method of claim 9 further comprising admixing air heated to at least 200° F. with the vaporized liquid chemical agent prior to flowing the chemical agent into the thermal oxidizer.

15. A thermal oxidizer for treating and destroying liquid chemical compounds, comprising:

(a) an inlet chamber for receiving a spray of a liquid chemical compound and for vaporizing the liquid chemical compound within the inlet chamber;

(b) an outlet for removing reaction gaseous products from the thermal oxidizer;

(c) a gaseous oxidation section located between the inlet and the outlet comprising a matrix bed of heat resistant material;

wherein said inlet chamber is substantially hollow and extends into the matrix bed of heat resistant material in the direction of the flow of the reactants through the oxidizer; and (d) a spray nozzle having a feed inlet to receive the liquid chemical compound and an outlet extending into the inlet chamber.

16. The thermal oxidizer of claim 15 wherein the spray nozzle further comprises an air inlet for receiving air.

17. The thermal oxidizer of claim 15 wherein said inlet chamber extends a distance of at least 10% of the length of the matrix bed.

18. The thermal oxidizer of claim 15 further comprising a heater for heating at least a portion of the oxidation section including a portion of the matrix bed of heat resistant material to a temperature exceeding at least about 1400° F.

19. The thermal oxidizer of claim 15 further comprising a first portion of the matrix bed adjacent to the inlet and a second portion of the matrix bed adjacent to the first portion of the matrix bed, and comprising a first heating system for heating the first portion of the matrix bed and a second heating system for heating the second portion of the matrix bed.

20. A process system for treating and destroying a liquid chemical compound, comprising:

(1) a thermal oxidizer comprising (a) an inlet chamber for receiving a spray of a liquid chemical compound and for vaporizing the liquid chemical compound;

(b) an outlet for removing reaction gaseous products from the thermal oxidizer;

(c) a gaseous oxidation section located between the inlet and the outlet comprising a matrix bed of heat resistant material;

wherein said inlet chamber is substantially hollow and extends into the matrix bed of heat resistant material in the direction of the flow of the reactants through the oxidizer; and (d) a spray nozzle having a feed inlet to receive the liquid chemical compound and an outlet extending into the inlet chamber; and (2) means for transporting the liquid chemical compound to the inlet of the spray nozzle.

21. The process system of claim 20 wherein the spray nozzle further comprises an air inlet for receiving air.

22. The process system of claim 20 wherein the inlet chamber extends a distance of at least 10% of the length of the matrix bed.

* * * * *

UNITED STATES PATENT AND TRADEMARK OFFICE

CERTIFICATE OF CORRECTION

PATENT NO. : 5,819,673
DATED : October 13, 1998
INVENTOR(S) : Heywood et al.

It is certified that error appears in the above-indentified patent and that said Letters Patent is hereby corrected as shown below:

Col. 1, lines 29 & 30, delete space between the words "processing;" and "biological".

Col. 5, line 25, please delete "though" and insert therefor --through--.

Col. 11, line 62, please delete "a" and insert therefor --the--.

Signed and Sealed this

Twenty-fourth Day of August, 1999

*Attest:*

Q. TODD DICKINSON

*Attesting Officer*

*Acting Commissioner of Patents and Trademarks*